US006858977B2

(12) United States Patent
Nomura et al.

(10) Patent No.: US 6,858,977 B2
(45) Date of Patent: Feb. 22, 2005

(54) CATHODE-RAY TUBE AND CATHODE-RAY TUBE MANUFACTURING METHOD

(75) Inventors: Tsuneharu Nomura, Tokyo (JP); Norihiro Ohse, Kanagawa (JP); Tomohiko Abe, Tokyo (JP); Michihisa Yano, Kanagawa (JP); Seiji Kawaberi, Kanagawa (JP); Hisashi Kimura, Kanagawa (JP); Tsutomu Arai, Chiba (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 10/152,853

(22) Filed: May 23, 2002

(65) Prior Publication Data

US 2003/0015954 A1 Jan. 23, 2003

(30) Foreign Application Priority Data

Jun. 1, 2001 (JP) ..... P2001-167220

(51) Int. Cl.[7] ..... H01J 29/18

(52) U.S. Cl. ..... 313/479; 313/466; 313/402; 313/408

(58) Field of Search ..... 313/479, 402, 313/405, 408, 461, 466; 445/44–45; 427/64, 68

(56) References Cited

U.S. PATENT DOCUMENTS 3,562,518 A * 2/1971 Javorik et al. ..... 313/408
3,792,300 A * 2/1974 Benda et al. ..... 313/439
3,802,757 A * 4/1974 Benda et al. ..... 445/19
3,878,428 A * 4/1975 Kuzminski et al. ..... 313/408
4,128,790 A * 12/1978 Steeghs ..... 315/382
4,621,214 A * 11/1986 Bloom et al. ..... 313/402
4,758,193 A * 7/1988 Brown ..... 445/1
4,771,214 A * 9/1988 Takenaka et al. ..... 313/479
5,160,375 A * 11/1992 Otaki ..... 106/475
5,723,170 A * 3/1998 Kawase et al. ..... 427/64
5,751,102 A * 5/1998 Tanaka et al. ..... 313/466
5,789,854 A * 8/1998 Takizawa et al. ..... 313/478
5,820,920 A * 10/1998 Ariji et al. ..... 427/64
5,820,921 A * 10/1998 Kawase et al. ..... 427/64
5,821,686 A * 10/1998 Nomura et al. ..... 313/479
5,841,224 A * 11/1998 Kim et al. ..... 313/412
6,129,980 A * 10/2000 Tsukada et al. ..... 428/327
6,456,000 B1 * 9/2002 Lee ..... 313/479
6,559,590 B1 * 5/2003 Mori et al. ..... 313/466

* cited by examiner

*Primary Examiner*—Joseph Williams
*Assistant Examiner*—Dalei Dong
(74) *Attorney, Agent, or Firm*—Ronald P. Kananen; Rader, Fishman & Grauer PLLC

(57) ABSTRACT

The cathode-ray tube according to the present invention has on the inner surface of the funnel section of the body thereof a laminated layer comprising a first layer of black material, a metal backing layer and a second layer of black material.

According to the configuration of the cathode-ray tube of the present invention, stray light reflected within the body of the cathode-ray tube is absorbed by the first layer of black material on the inner surface of the funnel, while stray light reflected off the inner surface of the funnel is absorbed by the second layer of black material. This makes it possible to reduce the amount of stray light incident upon the effective screen area of the panel section.

2 Claims, 6 Drawing Sheets

CATHODE-RAY TUBE AND CATHODE-RAY TUBE MANUFACTURING METHOD

BACKGROUND OF INVENTION

1. Field of the Invention

The present invention relates to a cathode-ray tube and a method for manufacturing a cathode-ray tube suitable for use in a projection-type display, for example.

2. Description of the Related Art

For cathode-ray tubes for use in projectors and the like, what is called deposition-type glass (deposited bulbs), in which the panel and funnel sections of the body of the cathode-ray tube are integrally formed, is used.

By reason of glass formation, the inner wall of the funnel section and the side of the panel section generally constitute mirror finished surfaces in cathode-ray tubes of this type.

When an electron beam is irradiated upon the fluorescent surface created on the inner surface of the panel section, part of it is reflected off in the form of reflected electrons.

Since the inner wall of the funnel section and the sides of the panel section constitute mirror-like surfaces, as described above, the reflected electrons are reflected back off the inner wall and are again incident upon the fluorescent surface. This has a marked deteriorating effect on the contrast of the projected image.

In the case where a plurality of cathode-ray tubes are located next to each other, such as cathode-ray tubes in a television receiver using a projector, light leaking from the funnel section and the sides of the panel section of a cathode-ray tube affects each other and causes deterioration of the contrast.

When an excellent quality of displayed image is to be achieved in a monochrome cathode-ray tube like those used in projectors, an especially high degree of intensity and contrast is required.

In order to counteract factors which cause the contrast to deteriorate, one measure that has conventionally been adopted involves coating the inner wall of the funnel and the sides of the panel with a black material, such as carbon, thereby reducing and absorbing the reflection of light as much as possible.

When the measure is employed for a cathode-ray tube using deposition-type glass in which the panel and funnel sections are integrally formed, coating the inner surface is performed by inserting a brush or other coating implement through the neck section and rotating the glass.

Accordingly, it has hitherto been possible to coat only that part of the inner surface of the funnel which has a circular cross-section. It also has been difficult to ensure that the funnel section and the sides of the panel section are coated evenly with the black material.

Meanwhile, if a thick coating is applied to the inner wall in such a manner as to avoid missing anywhere, the black material tends to peel off, thereby causing the withstand voltage properties of the cathode-ray tube to deteriorate.

The inner surface of the funnel section needs a furnished conductive film in order to ensure that high voltage supplied from the anode button is fed to the fluorescent surface and the inner surface of the funnel section of the body of the cathode-ray tube has the same potential.

Since it is possible to coat only that part of the inner surface of the funnel which has a circular cross-section in a cathode-ray tube using deposition-type glass, it has been necessary instead to deposit aluminum over a wide area as a metal backing layer in order to form an inner conductive film.

However, depositing a metal backing layer over a wide area in this manner, in order to form the conductive film, results in the fact that the contrast of the image deteriorates by reason of reflected electrons and stray light caused by not being absorbed sufficiently and reflected off the metal-backing layer.

Examples of stray light which causes the contrast of the image to deteriorate include stray light caused by light reflected off the inner surface of the body of the cathode-ray tube being subject to multiple reflection within the glass thereof and returning to the front surface of the panel and stray light caused by light reflected off the inner surface of the funnel section of the body of the cathode-ray tube returning directly to the front surface of the panel.

In order to solve the abovementioned disadvantages, the present invention proposes a cathode-ray tube having an excellent quality of image with a highly enhanced contrast and a method of manufacturing such a high-contrast cathode-ray tube by reducing stray light and the re-entering of reflected electrons through the fluorescent surface thereof.

SUMMARY OF THE INVENTION

A cathode-ray tube according to the present invention has a laminated layer comprising a first layer of black material, a metal backing layer and a second layer of black material on the inner surface of the funnel section of the body thereof.

According to the configuration of the present invention, since the laminated layer comprising a first layer of black material, a metal backing layer and a second layer of black material is formed on the inner surface of the funnel section of the body, stray light reflected within the body of the cathode-ray tube is absorbed by the first layer of black material on the inner surface of the funnel and stray light reflected off the inner surface of the funnel is absorbed by the second layer of black material.

Therefore, it becomes possible to reduce the amount of stray light incident upon the effective screen of the panel section.

A method for manufacturing a cathode-ray tube according to the present invention includes a step of dripping a solution containing the black material from a nozzle onto the inner surface of the body of the cathode-ray tube to form the layer of black material when a cathode-ray tube having a layer of black material on the inner surface of the body thereof is manufactured.

According to the method of the present invention described above, since the layer of black material is formed by dripping a solution containing the black material from a nozzle onto the inner surface of the body of the cathode-ray tube, it is possible to form evenly and without difficulty a layer of the black material irrespective of the cross-sectional shape of the body of the cathode-ray tube.

Another method for manufacturing a cathode-ray tube of the present invention includes a step of immersing the inner surface of the body of the cathode-ray tube in a solution containing the black material to form the layer of black material when a cathode-ray tube having a layer of black material on the inner surface of the body thereof is manufactured.

According to the method of the present invention described above, since the layer of black material is formed by immersing the funnel section of the body of the cathode-ray tube in a solution containing the black material, it is possible to form evenly and without difficulty a layer of the black material irrespective of the cross-sectional shape of the body of the cathode-ray tube.

DESCRIPTION OF THE PREFERRED EMBODIMENTS

First Embodiment

Figure 1:
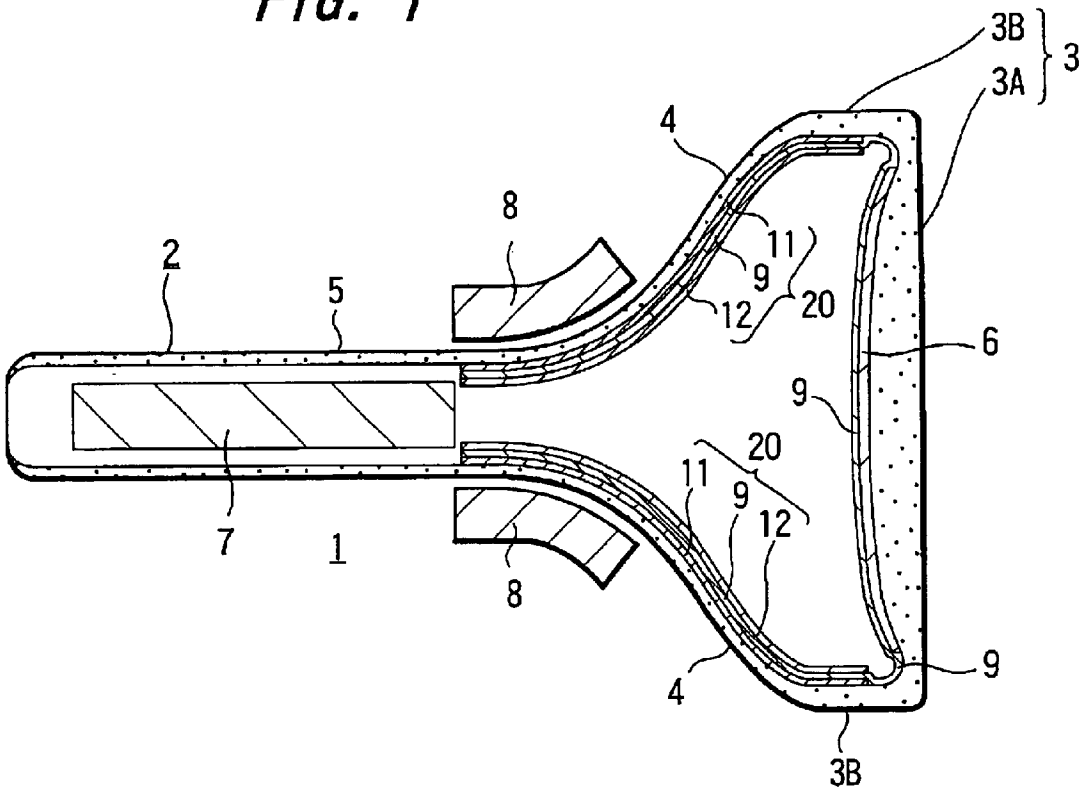
FIG. 1 is a cross-sectional view of a cathode-ray tube according to an embodiment of the present invention.

FIG. 1 shows a schematic structural diagram(cross-sectional view) of a first embodiment of the present invention. The cathode-ray tube 1 comprises a glass body 2, which has a panel section 3, a funnel section 4 and a neck section 5.

On the inner wall of the front surface 3A of the panel section 3 of the body 2 of the cathode-ray tube is formed a fluorescent surface, while an electron gun 7 is located within the neck section 5 and a deflecting yoke 8 is provided on the outer periphery of the funnel section 4 and neck section 5.

The cathode-ray tube 1 is of the deposited glass type, having a configuration of the body 2 in which the panel section 3 and funnel section 4 are integrally formed.

Figure 2:
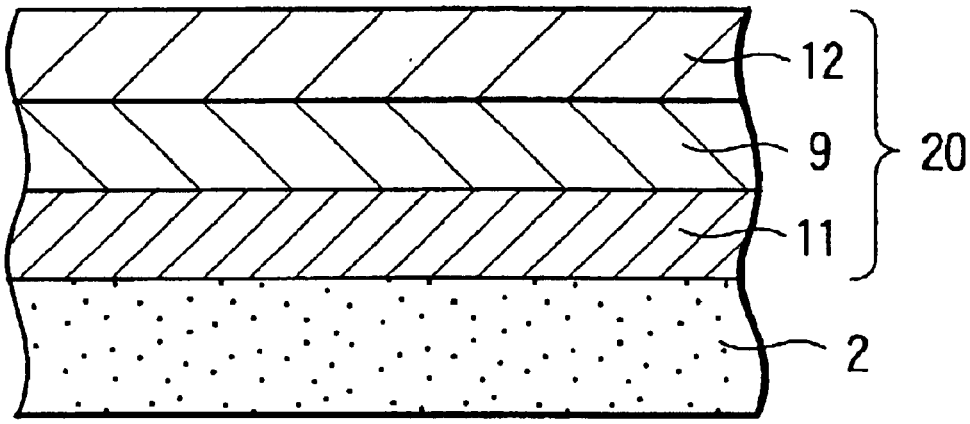
FIG. 2 is an enlarged cross-sectional view of the principal part of the cathode-ray tube according to the embodiment of the present invention.

In the present embodiment, as shown in FIG. 1 and the enlarged cross-sectional view of FIG. 2, a three-layer laminated film 20 comprising a first layer of black material 11, a metal backing layer 9 and a second layer of black material 12 is formed across the inner surface ranging from the funnel section 4 co a skirt portion 3B of the panel section 3, in particular.

It is noted that of the three layers which constitute the laminated film 20, only the metal backing layer 9 is formed also across the front surface side 3A of the panel section, and it includes the effective screen area.

Any light-absorbing black material, such as carbon, with or without the addition of SIC may be utilized in the first and second layers of black material 11, 12.

As the metal backing layer 9, any metal, such as aluminum, which is generally used in metal backing layers, may be used. This layer can be formed by means of deposition, for example.

The first layer of black material 11 absorbs light reflected within the glass of the body 2 of the cathode-ray tube, thereby making it possible to reduce the amount of stray light reflected from within the glass.

The second layer of black material 12 absorbs light incident upon the inner surface of the skirt portion 3B of the panel section 3 and the inner surface of the funnel section 4 of the body 2 of the cathode-ray tube, thereby making it possible to reduce the amount of stray light reflected off the inner surface.

The second layer of black material 12 also disperses or absorbs electrons reflected off the fluorescent surface 6, thereby making it possible to reduce the degree to which reflected electrons are again incident upon the fluorescent surface 6.

Moreover, absorption of light by the first and second layers of black material 11, 12 makes it possible to reduce the degree to which light leaks out of the cathode-ray tube 1.

Consequently, such deterioration of the contrast as that caused by leaking light in the case where a plurality of cathode-ray tubes 1 are located next to each other is prevented.

The upper and lower layers of black material 11, 12 which constitute the laminated film 20 may be formed, for example, by one of the two following methods:

(1) By dripping a solution containing the black material from a nozzle onto the inner surface of the body 2 of the cathode-ray tube; or (2) By immersing the inner surface of the body 2 of the cathode-ray tube in a solution containing the black material.

Figure 3:
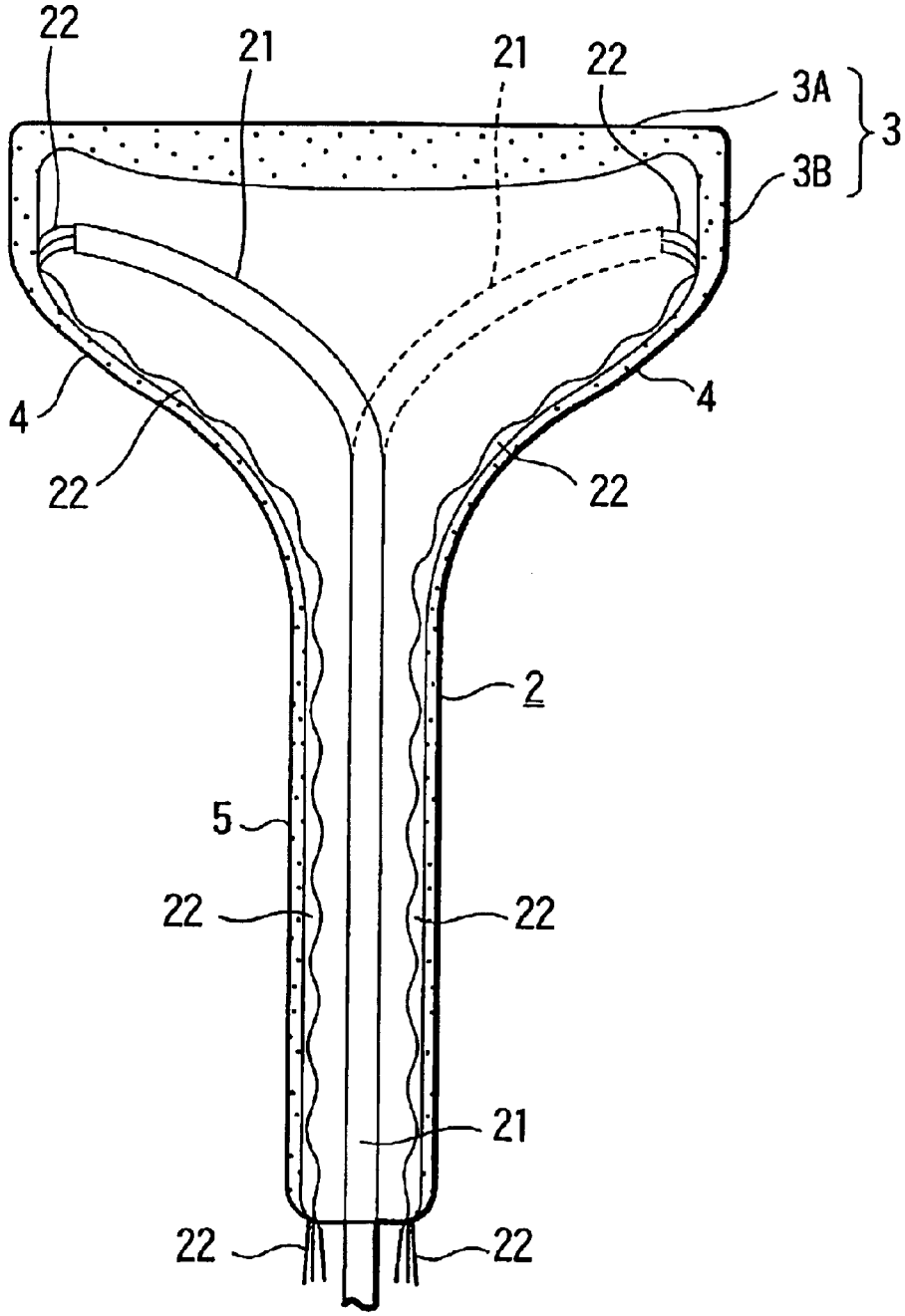
FIG. 3 is a cross-sectional view illustrating an embodiment of a method for forming the layer of black material.

FIG. 3 illustrates in detail method (1), i.e., dripping a solution containing the black material from a nozzle onto the inner surface of the body 2 of the cathode-ray tube.

To begin with, the body 2 of the cathode-ray tube made from deposition-type glass with the panel section 3, the funnel section 4 and the neck section 5 integrally formed is erected in such a manner that the panel section 3 is at the top.

Next, a nozzle 21 is inserted through the neck section 5, and the tip of the nozzle 21 is extended until it reaches by the side of the skirt portion 3B of the panel section 3.

Now, a solution 22 containing the black material adjusted to a suitable viscosity is dripped from the tip of the nozzle 21 onto the inner surface of the body 2 of the cathode-ray tube, specifically the inner surface of the skirt portion 33 in this case.

On dripping the solution 22 containing the black material, the solution 22 flows downwards along the inner surface of the body 2 of the cathode-ray tube, thereby coating the inner surface of the skirt portion 3B, the funnel section 4 and the neck section 5.

Either the body 2 of the cathode-ray tube or the nozzle 21 is now rotated around the axis of the body 2 of the cathode-ray tube to alter the position at which the solution 22 containing the black material is dripped, and dripping is repeated.

It is noted that it is preferable to control the position of the tip of the nozzle 21 so that an approximately specific distance between it and the inner surface of the body 2 of the cathode-ray tube is maintained at this stage. In this manner, it is possible to form the layers of black material 11, 12, ensuring that the thickness of the layers is appropriately controlled and nowhere is missed, even if the cross-section is not circular.

Thus, the layers of black material 11, 12 are formed on the inner surface of the body 2 of the cathode-ray tube by dripping the solution 22 containing the black material around the whole circumference.

Figure 4:
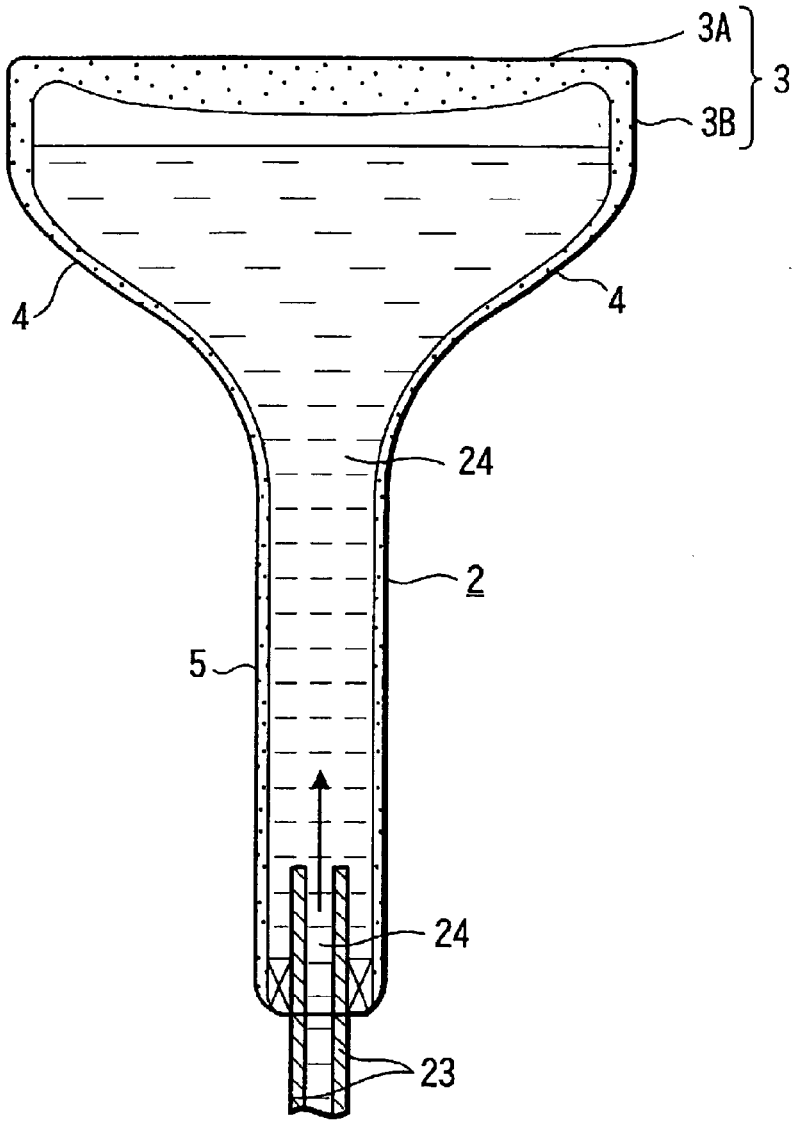
FIG. 4 is a cross-sectional view illustrating another embodiment of a method for forming the layer of black material.

FIG. 4 illustrates in detail method (2), i.e., immersing the inner surface of the body 2 of the cathode-ray tube in a solution containing the black material.

To begin with, the body 2 of the cathode-ray tube made from deposition-type glass with the panel section 3, the funnel section 4 and the neck sections 5 integrally formed is erected in such a manner that the panel section 3 is at the top.

Now, a supply pipe 23, through which a solution 24 containing the black material is fed onto the inner surface of the body 2 of the cathode-ray tube, is inserted, and the space between the supply pipe 23 and the neck portion 5 is sealed.

In this state, the solution 24 containing the black material is fed onto the inner surface of the body 2 of the cathode-ray tube from the supply pipe 23. When the surface of the solution 24 containing the black material reaches a predetermined position corresponding to the area where the layers of black material 11, 12 are to be formed, the position of the surface of the solution 24 is retained by stopping the flow, closing a valve not illustrated in the drawing, or by a similar means.

In this manner, it is possible to form the layers of black material 11, 12 on the inner surface of the body 2 of the cathode-ray tube, ensuring that the thickness of the layers is appropriately controlled and nowhere is missed, even if the cross-section is not circular.

Another feasible way of forming the layers of black material 11, 12 is by spraying a solution containing the black material through a nozzle. However, this requires the use of masking in order to ensure that the effective screen area and other unnecessary parts are not sprayed, and, in the absence of masking, it is difficult to control the area where the layers of black material 11, 12 are to be formed.

The conventional method of forming the layers of black material required the brush or other coating implement to be inserted through the neck section and brought into direct contact with the inner surface of the body 2 of the cathode-ray tube. As a result, it was difficult to evenly coat such parts as the inner surface of the fluorescent surface side of the funnel section 4 or the inner surface of the skirt portion 3B where the cross-section is not circular.

Compared with this, since dripping the solution 22 from the nozzle 21 does not involve direct contact with the inner surface of the body 2 of the cathode-ray tube, adjusting the flow and the distance between the nozzle 21 and inner wall makes it possible to control the process to form a layer having approximately uniform thickness without missing anywhere, even in parts where the cross-section is not circular.

Similarly, immersing the inner surface of the body 2 of the cathode-ray tube in the solution 24 makes it possible to control the process to form a film having approximately uniform thickness without missing anywhere, even in parts where the cross-section is not circular.

Moreover, controlling the surface of the solution makes it easy to control the area over which the layers of black material 11, 12 are formed.

In the cathode-ray tube 1 according to the present embodiment, the laminated film 20 comprising the first layer of black material 11, the metal backing layer 9 and the second layer of black material 12 is formed on the inner surface of the funnel section 4 and the inner surface of the skirt portion 3B of the body 2 of the cathode-ray tube. This configuration allows the first layer of black material 11 to reduce stray light reflected from within the glass of the body of the cathode-ray tube.

It also allows the second layer of black material 12 to reduce stray light reflected off the inner surface of the funnel section 4 and the inner surface of the skirt portion 3B of the panel section 3 of the body 2 of the cathode-ray tube.

Accordingly, it is possible to reduce deterioration of contrast of the image due to stray light caused by these various sources.

Furthermore, she layers of black material 11, 12 allow the amount of light leaking out of the cathode-ray tube 1 to be reduced, and, as a result, make it possible to prevent deterioration of contrast due to leaked light.

Moreover, the second layer of black material 12 allows electrons reflected off the fluorescent surface 6 to be dispersed or absorbed.

In this manner, it is possible to reduce the degree to which reflected electrons are again incident upon the fluorescent surface 6.

This also makes it possible to prevent deterioration of contrast due to reflected electrons incident again upon the fluorescent surface 6.

Consequently, the present embodiment makes it possible to improve the contrast of the image on the cathode-ray tube land to achieve an excellent image with a high degree of contrast.

In conclusion, by adopting either the methodby which the layers of black material 11, 12 are formedby dripping a solution 22 containing the black material through the nozzle 21 on to the inner surface of the body 2 of the cathode-ray tube, as illustrated in FIG. 3, or of the body 2 of the cathode-ray tube being immersed in a solution 24 containing the black material, as illustrated in FIG. 4, the present embodiment allows the layers of black material 11, 12 to be formed without difficulty and without missing anywhere. Moreover, it is easy to control the area over which the layers of black material 11, 12 are formed.

This means that it is possible to manufacture with minimum waste the cathode-ray tube 1 according to the present embodiment, having layers of black material 11, 12 formed on the inner surface of the body 2 thereof and a high degree of contrast.

When the cathode-ray tube 1, according to the present embodiment illustrated in FIG. 1 is employed in conjunction with a projector, it forms a liquid-cooled, cathode-ray tube (not illustrated in the drawings), such as a sealed receptacle to which a concave lens is attached containing coolant is located at the front surface 3A of the panel section 3 of the cathode-ray tube 1 and another lens is placed in front of that.

This configuration makes it possible to project an image outputted from the cathode-ray tube onto a screen of the projector or the like.

As a result, a projector having the configuration of the cathode-ray tube 1 according to the present embodiment makes it possible to realize a projection-type display with a high degree of contrast and excellent image quality.

Second Embodiment

Figure 5:
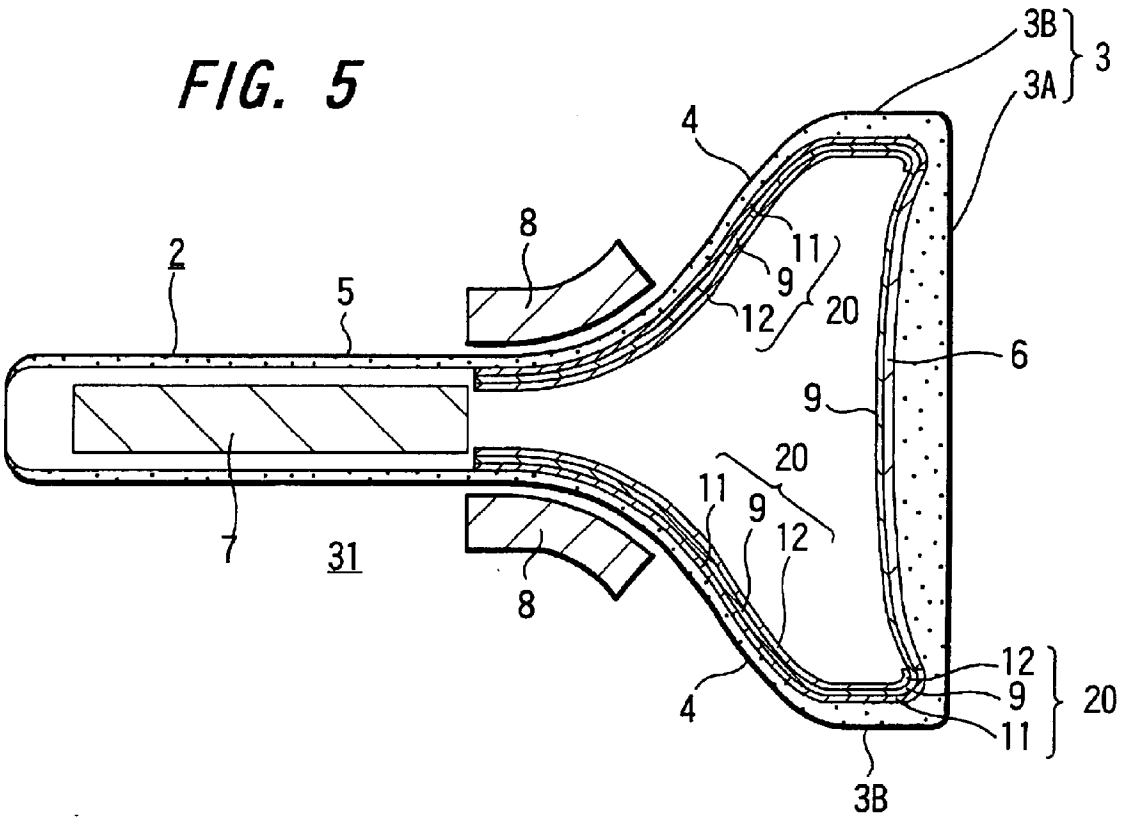
FIG. 5 is a cross-sectional view of the cathode-ray tube according to another embodiment of the present invention.
Figure 6:
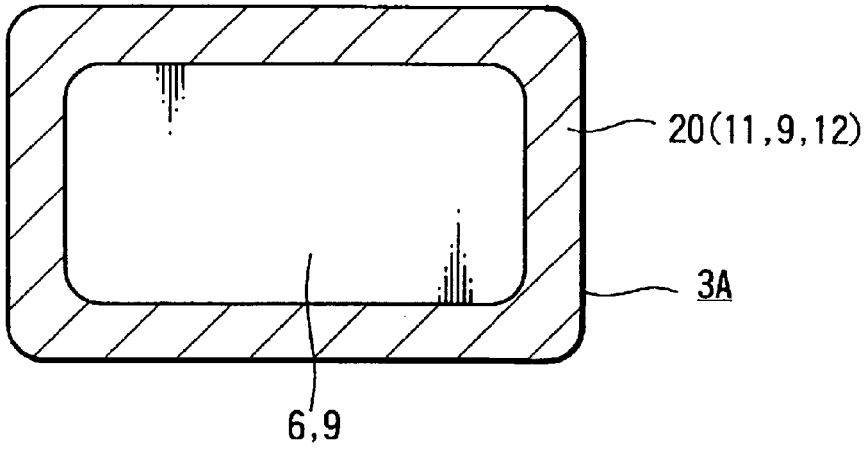
FIG. 6 is a front view of the cathode-ray tube according to another embodiment of the present invention.

FIG. 5 shows a schematic structural view (cross-sectional view) of a cathode-ray tube according to a second embodiment of the present invention. FIG. 6 shows a front view of the cathode-ray tube in FIG. 5.

In the present embodiment, the three-layer laminated film 20 comprising the first layer of black material 11, the metal backing layer 9 and the second layer of black material 12 is formed across not only the inner surface ranging from the funnel section 4 to the skirt portion 3B of the panel section 3 but also the frame portion (cf. FIG. 6) of the front surface 3A of the panel section 3 other than the effective screen area, and thus a cathode-ray tube 31 is constituted.

In the present embodiment it also is possible to adopt either of the above-mentioned methods of forming the layers of black material on the inner surface of the panel section 3 and funnel section 4. That is to say either the method of dripping solution 22 containing the black material through the nozzle 21 onto the glass of the body 2 of the cathode-ray tubeor the method of immersing the inner surface of the body 2 of the cathode-ray tube in the solution 24 containing the black material.

In this manner, the layers of black material 11, 12 also can be formed without difficulty while appropriately controlling the thickness thereof.

When the method of immersing the frame portion of the front surface 3A of the panel section 3 other than the effective screen area in the solution 24 containing the black material illustrated in FIG. 4 is adopted for the purpose of forming the layers of black material 11, 12, it is possible to control the process, for example, by tilting the body 2 of the cathode-ray tube in such a manner that the surface of the solution comes close to the outer edge of the effective screen area. All that is required is to tilt the body of the cathode-ray tube successively in the four directions corresponding to the four sides of the effective screen area.

According to the embodiment described above, since the first layer of black material 11, the metal backing layer 9 and the second layer of black material 12 are laminated also across the frame portion of the front surface 3A of the panel section 3 other than the effective screen area, light which leaks out through this frame portion also can be absorbed.

Accordingly, deterioration of an image contrast caused by stray light reflected off the inner surface or within the glass of the body of the cathode-ray tube is prevented even more efficiently, and therefore it is possible to improve the contrast, which further contributes to achieving excellent quality with a high degree of contrast.

Both of the above embodiments have concentrated on the explanation of a cathode-ray tube which makes use of deposition-type glass (deposited bulbs) in which the panel section 3 and the funnel section 4 are integrally formed and the first layer of black material 11, the metal backing layer 9 and the second layer of black material 12 are laminated onto the inner surface of the body 2 of the cathode-ray tube 1.

According to the present invention, it is possible to laminate the above-described three layers 11, 9, 12 on the inner surface not only of a cathode-ray tube wherein the panel section 3 and the funnel section 4 are integrally formedbut also of a cathode-ray tube wherein the panel section 3 and the funnel section 4 are formed separately. For example, it is possible to laminate the three layers 11, 9, 12 on the inner surface in the same manner prior to a step of the panel section 3 and the funnel section 4 being made to form a single entity with deposited bulbs, or prior to a step of joining ordinary cathode-ray tubes formed by joining the panel and the funnel sections with a frit seal or the like.

If the panel section 3 and funnel section 4 are each formed separately, there is no need to stand the body 2 of the cathode-ray tube upright or insert the nozzle 21 or supply pipe 23 through the neck section. For example, the layers of black material 11, 12 can easily be formed by aiming the nozzle 21 approximately vertically onto the inner surface of the body 2 of the cathode-ray tube.

When the panel section 3 and funnel section 4 are each formed separately, it also is easy to form the metal layer 9 by means of deposition.

Further, the layers of black material 11, 12 also can be formed without difficulty when the method of immersing the body 2 of the cathode-ray tube in a solution containing the black material is adopted.

In this case, the three-layer laminated film 20 is first formed on the inner surface of the funnel section 4, the inner surface of the skirt portion 3B of the panel section 3 and, if required, the inner surface of the frame portion of the front surface 3A of the panel section 3 other than the effective screen area, and thereafter the panel section 3 and funnel section 4 are joined.

Moreover, in the present invention, the area where the three-layer laminated film 20 (11, 9, 12) is formed on the inner surface of the body of the cathode-ray tube is not restricted by any of the above embodiments.

In the present invention, it is sufficient for the three-layered laminated film 20 (11, 9, 12) to be formed only on the inner surface of the funnel section 4 especially the part which is not circular in shape), and it may be formed as required on the skirt portion 3B and the front surface 3A other than the effective screen area of the panel section 3.

However, the metal backing layer 9 is by necessity formed also across the inner surface of the effective screen area on the front surface 3A of the panel section 3.

The method for manufacturing a cathode-ray tube according to the present invention is not restricted to where a three-layer laminated film 20 (11, 9, 12) is to be formed as in each of the above embodiments, but it can be applied to where a layer of black material is to be formed on the inner surface of the body of the cathode-ray tube.

For example, it may also be applied in the same manner in such configurations as the glass-layer of black material, the glass-metal backing layer-layer of black material, and the glass-layer of black material-metal backing layer.

In any of these configurations, applying the manufacturing method of the present invention allows layers of black material to be formed easily and without missing anywhere. It also makes it possible to control the area on which they are formed without difficulty.

Consequently, it is possible with minimum waste to manufacture cathode-ray tubes having layers of black material formed on the inner surface of the body thereof and a high degree of contrast.

The cathode-ray tube according to the present invention makes it possible to obtain an excellent image with a high degree of contrast on the cathode-ray tube by preventing stray and leaked light causing the contrast to deteriorate.

In conclusion, the method for manufacturing cathode-ray tubes according to the present invention allows the layers of black material to be formed on the inner surface of the body of the cathode-ray tube without difficulty and without missing anywhere. Moreover, the method makes it easy to control the area over which the layers of black material are formed.

This means that it is possible with minimum waste to manufacture cathode-ray tubes having layers of black material formed on the inner surface of the body thereof and a high degree of contrast.

Having described preferred embodiments of the invention with reference to the accompanying drawing, it is to be understood that the invention is not limited to those precise embodiments and that various changes and modifications could be effected therein by one skilled in the art without departing from the spirit or scope of the invention, as defined in the appended claims.

What is claimed is:

1. A cathode-ray tube composed of deposited glass in which a panel section, a funnel section, and a neck section of a cathode-ray tube body are integrally formed, wherein a first black material layer to absorb light that reflects within the glass of said cathode-ray tube body and a second black material layer to absorb stray light reflected in said cathode-ray tube body are formed along the inner surface of said cathode-ray tube body ranging from said funnel section to a skirt portion of said panel section;

a metal backing layer is formed between said first black material layer and said second material layer; and said first black material layer said metal backing layer, and said second black material layer are also formed along a frame portion, said frame portion constituting a portion of the inner front surface of said panel section other than an effective screen area.

2. A cathode-ray tube according to claim 1, wherein only the metal backing layer is also formed along the front surface side of said panel section, including said effective screen area.

* * * * *